United States Patent [19]

Patton

[11] 4,135,652

[45] Jan. 23, 1979

[54] COMBINATION BOOT SLIP AND JACK

[75] Inventor: Henry W. J. Patton, Snyder, Tex.

[73] Assignee: Raymond Lee Organization, Inc., New York, N.Y.

[21] Appl. No.: 771,083

[22] Filed: Feb. 23, 1977

[51] Int. Cl.[2] ..... A47J 51/02

[52] U.S. Cl. ..... 223/116

[58] Field of Search ..... 223/113, 114, 115, 116, 223/117

[56] References Cited

U.S. PATENT DOCUMENTS

| | | | |
|---|---|---|---|
| 28,927 | 6/1860 | Wheeler | 223/113 |
| 206,523 | 7/1878 | Bartine | 223/115 |

*Primary Examiner*—George H. Krizmanich

*Attorney, Agent, or Firm*—Howard I. Pobell

[57] ABSTRACT

An appliance to enable a person to install on or remove a boot from his foot without requiring use of his hands. The device is in the form of a pair of spaced vertical standards joined to a common base with brackets mounted on the internal opposing faces of the standards for holding of a loose boot by means of engagement to holes in the sides of the boot or cord loops extending from the sides of the boot. A treadle is hinged to a projection extending rearwards of the base and pivotally mounted to the rear of a U-shaped boot jack that is pivotally mounted between the standards so that a boot, to be removed from a foot, may be clamped by the book jack with the second foot of the user pressed on the treadle to pivot the boot jack against the withdrawal force of the first foot being freed of the clamped boots.

2 Claims, 3 Drawing Figures

COMBINATION BOOT SLIP AND JACK

SUMMARY OF THE INVENTION

My invention is an appliance to enable a person to install on or remove a boot from his foot without requiring use of his hands. The device is in the form of a pair of spaced vertical standards joined to a common base with brac-ets mounted on the internal opposing faces of the standards for holding of a loose boot by means of engagement to holes in the sides of the boot or cord loops extending from the sides of the boot. A treadle is hinged to a projection extending rearwards of the base and pivotally mounted to the rear of a U-shaped boot jack that is pivotally mounted between the standards so that a boot, to be removed from a foot, may be clamped by the boot jack with the second second foot of the user pressed on the treadle to pivot the boot jack against the withdrawal force of the first foot being freed of the clamped boots.

BRIEF DESCRIPTION OF THE DRAWINGS

The objects and features of the invention may be understood with reference to the following detailed description of an illustrative embodiment of the invention, taken together with the accompanyine drawings in which.

DESCRIPTION OF THE PREFERRED EMBODIMENT

Figure 1:
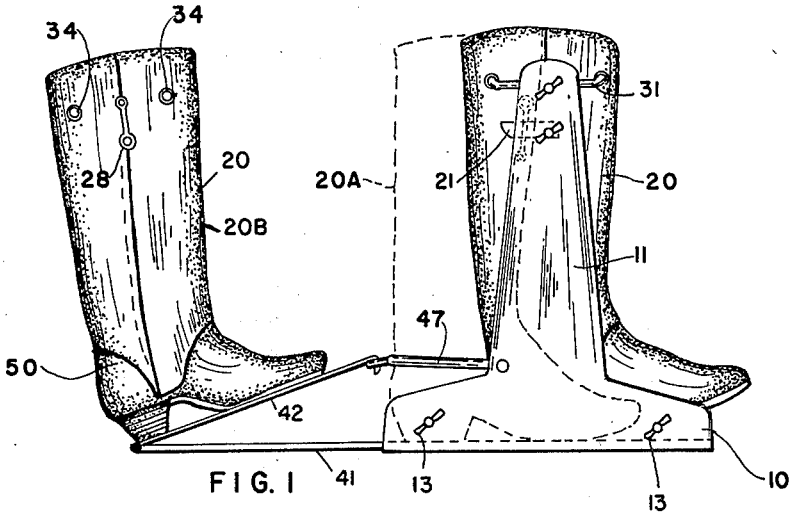
FIG. 1 is a side view of the invention in use.
Figure 2:
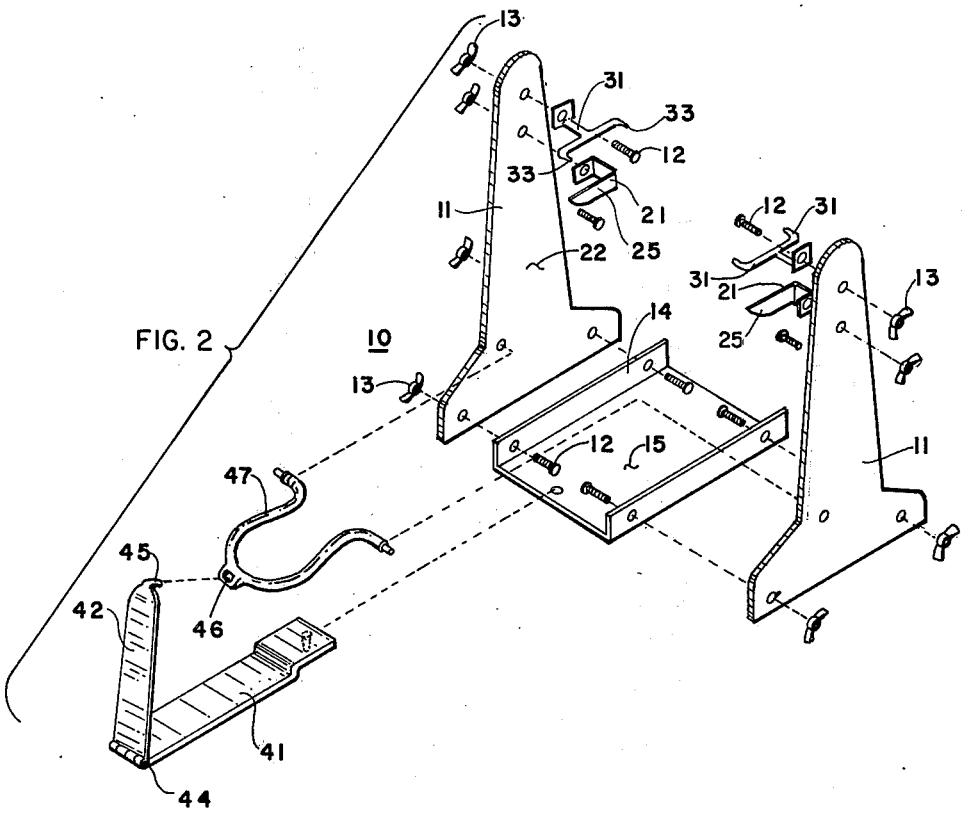
FIG. 2 is an exploded perspective view of the invention.
Figure 3:
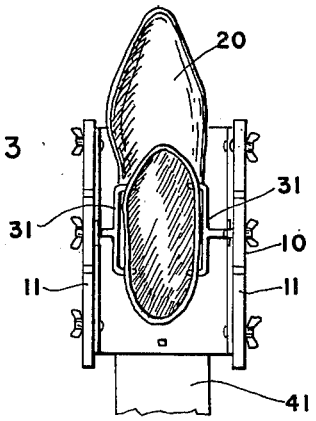
FIG. 3 is a detail plan view of the invention.

Turning now descriptively to the drawings, in which similar reference characters denote similar elements throughout the several views, FIGS. 1–3 illustrate the device 10 which is formed of a pair of vertical spaced standards 11 joined by screws 12 and wing nuts 13 to opposed side flanges 14 of a base plate 15.

A first hanger bracket 21 is bolted to the inside face 22 of each standard 11 and formed as a U-shape member, with a free leg section 25 extending rearwards along the horizontal axis so as to fit inside a vertical loop strap 28 fastened externally on each side of a boot 20 into which the user is to step so as to suspend the boot 20 above the base plate 15, while the user inserts a foot into the suspended boot.

A second hanger bracket 31 is bolted to the inside face 22 of each standard 11 and formed with two spaced projecting hook sections 33 for fitting into spaced holes 34 of a boot so as to suspend the boot by holes 34 as shown in FIG. 3.

Thus, boots with loop straps 28 or with spaced holes 34 may be suspended by either the first or the second hangers as desired.

An extension plate 41 is bolted to the base plate 15 so as to extend rearwards from base plate 15. A treadle 42 is pivotally hinged by hinge pin 44 to plate 41, with the forward end 45 of plate 41 treadle shaped as a hook that fits in an eye 46 at the rear of a U-shaped boot jack 47 pivotally mounted to each standard 11. In use, for removal of a boot 20A from a first foot, the user inserts boot 20A into the U-shaped boot jack 47 and presses with his second foot 50 which may be in boot 20B against treadle 42 to apply a force against the first boot to react against the withdrawal force of his first foot from boot 20A with boot jack 47 pivoting to permit both upward and rearward movement of the first foot out of first boot 20A.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A device for use installing a boot on a foot of the user without the use of the user's hands, comprising
   a base plate to which a pair of spaced vertical standards is mounted, together with pivotal means shaped to fasten about the shank of the boot for retention of the boot while the user removes his foot from said boot, in which the pivotal means comprises a U-shaped boot jack shaped to fasten about the shank of a boot and pivoted to each standard with a treadle hooked to said boot jack, said treadle pivotably mounted to an extension of the base plate behind the boot jack, such that downward pressure applied on said treadle by a second foot of a user applies a downward force to the boot jack while simultaneously pivoting the boot jack to permit the user to withdraw upwardly and rearwardly a first foot out of a boot, the shank of which is fastened in said boot jack, and such that the said first foot may be withdrawn towards the said second foot positioned on the treadle.

2. The combination as recited in claim 1 in which each standard is fitted with hanger means for suspension of a boot above the base for use in detachable suspending a boot to enable a user to insert a foot in said boot,
   said hanger means comprising hook means mounted on each standard and oriented to project towards the opposed standard so as to engage in holes in the adjacent side of a boot located between the two standards.

* * * * *